United States Patent [19]

Onozuka et al.

[11] Patent Number: 5,023,470

[45] Date of Patent: Jun. 11, 1991

[54] ELECTRONIC FLASH CHARGING CIRCUIT

[75] Inventors: Haruo Onozuka; Takao Umezu; Muneyoshi Sato, all of Saitama; Seiji Takada, Tokyo, all of Japan

[73] Assignee: Fuji Photo Film Co., Ltd., Kanagawa, Japan

[21] Appl. No.: 339,987

[22] Filed: Apr. 18, 1989

[30] Foreign Application Priority Data

Apr. 18, 1988 [JP] Japan ..... 63-95133

[51] Int. Cl.[5] ..... A03B 15/05

[52] U.S. Cl. ..... 307/108; 354/127.1; 315/241 P

[58] Field of Search ..... 307/66, 108; 320/2, 320/21, 50; 354/412, 418, 127.1; 315/209 R, 232, 241 R, 241 P, 241 S

[56] References Cited

U.S. PATENT DOCUMENTS 4,743,929 5/1988 Taniguchi et al. ..... 354/127.1
4,924,149 5/1990 Nishida et al. ..... 354/127.1 X
4,975,721 12/1990 Tominaga et al. ..... 354/127.1

*Primary Examiner*—Derek S. Jennings
*Attorney, Agent, or Firm*—Young & Thompson

[57] ABSTRACT

An electronic flash charging circuit for use with a camera having a power source common to a microcomputer that controls a plurality of camera functions and to an electronic flash. The charging circuit has a booster circuit for boosting a charging voltage with which a main capacitor of the electronic flash is charged and a controller that causes the booster circuit to operate intermittently, thereby intermittently charging the main capacitor.

11 Claims, 2 Drawing Sheets

ELECTRONIC FLASH CHARGING CIRCUIT

BACKGROUND OF THE INVENTION

The present invention relates to a camera with an electronic flash, and more particularly to an electronic flash charging circuit incorporated in a camera equipped with electrically controlled elements as well as an electronic flash.

Compact cameras have been developed with improved automatic control functions, such as automatic focusing, automatic exposure, automatic film winding, effected by means of a microcomputer. When an electronic flash is built into such a compact camera, it is preferred to use a power source common to all of the electrically controlled elements in order to ensure that the compact camera does indeed remain compact in size.

Charging a capacitor of the electronic flash causes a potential drop. If the potential of the power source drops lower than a potential sufficient for the microcomputer to operate effectively, the microcomputer does not operate properly when the capacitor of the electronic flash is being charged, whereby the camera operation will come to a standstill.

To operate the microcomputer effectively with a potential lower than its effective operating potential, it has been proposed that a voltage compensating circuit be provided or that a back-up capacitor for noise elimination having a large capacity, be provided in order to back up or support the microcomputer. Such an incorporation of an electronic flash charging circuit including a large capacity back-up capacitor or a voltage compensating circuit is, however, apt to increase not only the size but also the cost of the camera.

OBJECTS OF THE INVENTION

It is, therefore, a primary object of the present invention to provide an electronic flash charging circuit which enables a microcomputer for controlling camera operations to operate effectively even when the electronic flash is being charged.

It is another object of the present invention to provide an electronic flash charging circuit which can back up or support the operation of a microcomputer of a camera without providing a voltage compensating circuit or a large capacity back-up capacitor.

SUMMARY OF THE INVENTION

The above and other objects of the present invention are achieved by a camera having a power source common to a microcomputer that controls various camera functions and an electronic flash charged by a charging circuit in accordance with the present invention. The charging circuit includes booster circuit means for boosting the voltage with which a main capacitor of the electronic flash is charged and control means that causes the booster circuit means to operate intermittently, whereby the charging of the main capacitor is intermittently repeated.

According to a preferred embodiment of the present invention, the control means includes a transistor as a switching means, of which the emitter is connected to an input terminal of the booster circuit means, which is preferably a blocking oscillator. The base of the switching transistor is fed with a signal changing alternately between a high and a low level. When the switching transistor receives a high level of signal, the blocking oscillator starts oscillation, charging the main capacitor for the period that the signal is maintained at the high level.

DETAILED DESCRIPTION OF THE INVENTION

Figure 1:
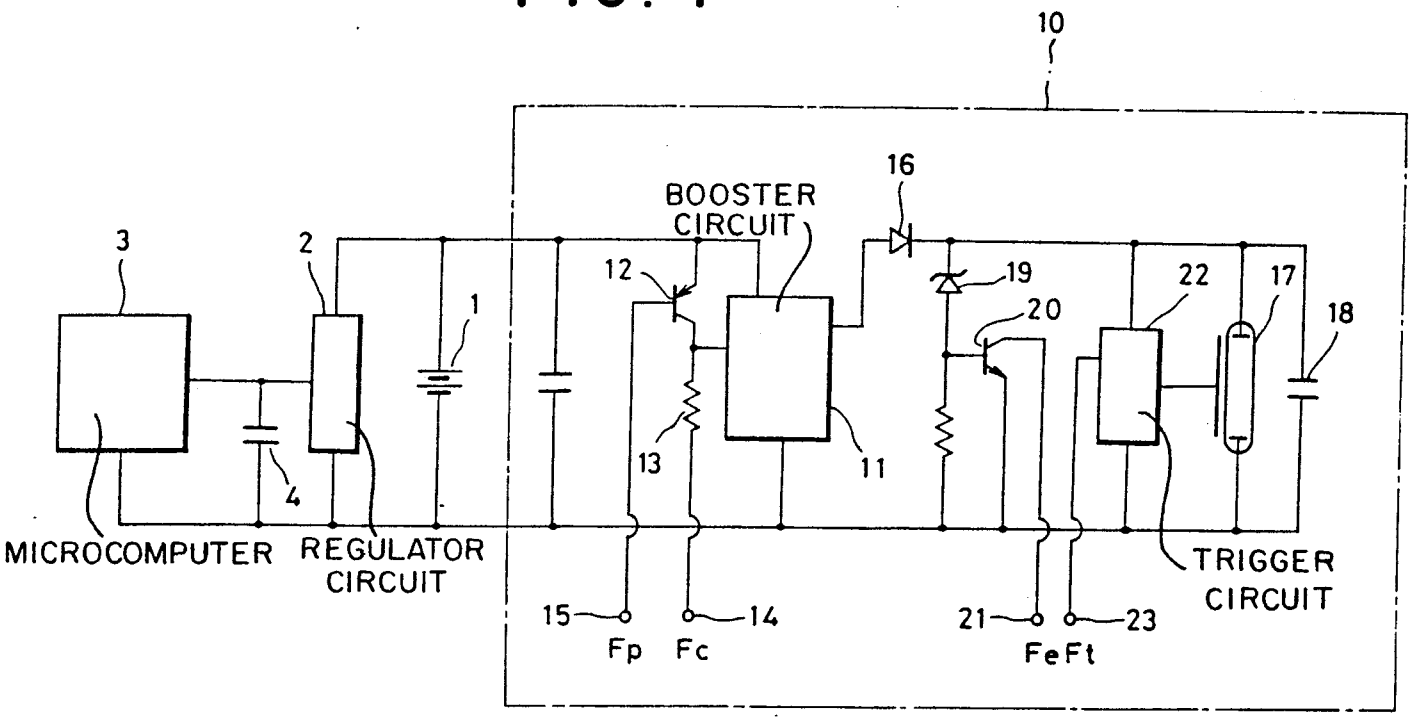
FIG. 1 is a schematic diagram showing an electronic flash charging circuit in accordance with a preferred embodiment of the present invention.
Figure 2:
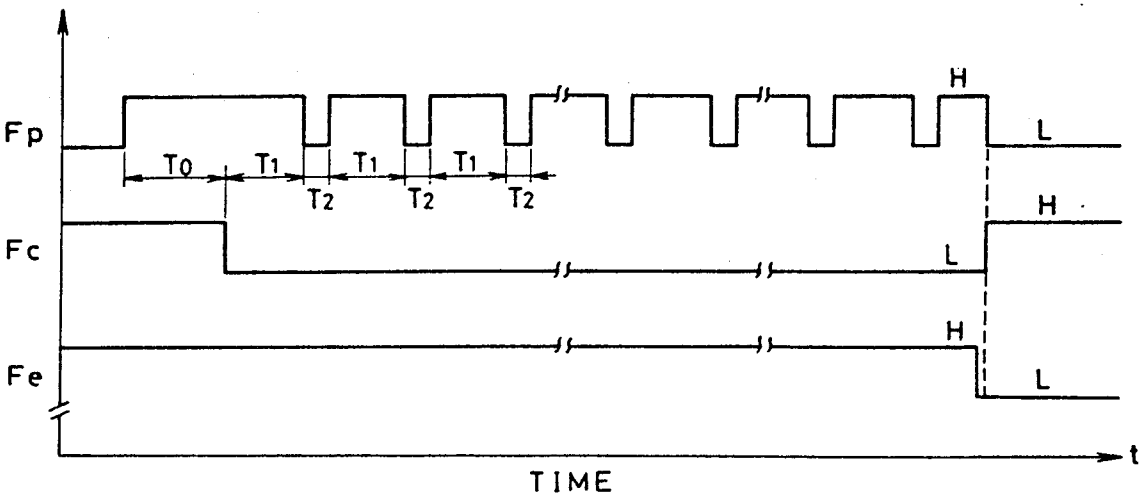
FIG. 2 is a timing chart of various control signals for controlling the operation of the charging circuit shown in FIG. 1.

Referring to the drawings, particularly to FIG. 1, an electronic flash charging circuit 10 incorporated in a computer controlled automatic camera according to a preferred embodiment of the present invention is shown, which is connected to a power source 1. A microcomputer 3 is connected to the power source 1 through a regulator circuit means 2. A back-up capacitor 4 is connected to the microcomputer 3 parallel to the power source 1.

A booster circuit 11, which is a blocking oscillator, is connected at its input side to both the power source 1 and the emitter of a transistor 12 functioning as a switching means. The collector of the transistor 12 is connected to an input terminal 14 through a resistance 13. A charge signal $F_c$ for the initiation of charging is input to the electronic flash charging circuit 10 through the input terminal 14 from the microcomputer 3. The base of the transistor 12 is connected to an input terminal 15. A prohibiting signal $F_p$ for the prohibition of charging is input to the electronic flash charging circuit 10 through the input terminal 15 from the microcomputer 3.

The booster circuit 11 is connected at its output side to a rectifying diode 16 of which the cathode is connected to a discharge tube 17. A main capacitor 18 is connected to the booster circuit 11 in parallel with respect to the discharge tube 17. The rectifying diode 16 is also connected at the cathode to the base of a transistor 20 functioning as a switching means through a Zener diode 19. The collector of the transistor 20 is connected to an output terminal 21. When the transistor 20 turns on or conductive, a low level potential L is present at the output terminal 21, whereby an end signal $F_e$ for termination of charging is output.

A trigger circuit 22 is connected to the booster circuit 11 in parallel with respect to the capacitor 18. A trigger signal $F_t$ is input to the trigger circuit 22 through the trigger terminal 23 in synchronism with releasing the shutter of the camera.

Immediately after a flash exposure, the microcomputer 3 changes the prohibiting signal $F_p$ to a high level H from a low level L, so as to remove the prohibition of charging and keeps the prohibiting signal $F_p$ at the high level H for a predetermined period of time (which is defined by a holding period $T_0$+ a charging period $T_1$). At the end of the time period $T_0$, the microcomputer 3 changes the charge signal $F_c$ to a low level L from a high level H and keeps the charge signal $F_c$ at the low level L. At this time, since the prohibiting signal $F_p$ is still kept at the high level H, the transistor 12 turns on or conductive, causing the booster circuit 11 to start oscillation and the rectifying diode 16 rectifies output from the booster circuit 11, charging the main capacitor 18. After the first charging period $T_1$, the microcomputer 3 changes the prohibiting signal $F_p$ to the low level L, causing the transistor 12 to turn off or nonconductive, whereby the booster circuit 11 stops its oscillation, so that the charging of the main capacitor 18 terminates. After a predetermined period of time or pause $T_2$, the microcomputer 3 changes again the prohibiting signal $F_p$ to the high level H and keeps the prohibiting signal $F_p$ at the high level H for the charging period of time $T_1$ for the second time. The charging of the main capacitor 18 for the predetermined period $T_1$ is intermittently repeated in the same way as for the second time.

The charging of the capacitor 18 is completed in that the microcomputer 3 repeats the procedure of alternately keeping the prohibiting signal $F_p$ at the high level H for the charging time $T_1$ and at the low level L for the pause $T_2$, namely the on-off control of the transistor 12, for appropriate times. Upon the completion of charging, a breakdown voltage is applied to the Zener diode 19, presenting a voltage at the base of the transistor 20 so as to turn the transistor 20 on or conductive. A low level of end signal $F_e$ is presented at the output terminal 21 and sent to the microcomputer 3. Upon the receipt of the low level end signal $F_e$, the microcomputer 3 changes the charge signal $F_c$ to the high level H from the low level and keeps the prohibiting signal $F_p$ at the low level. This readies the electronic flash charging circuit 10 for another flash. When the shutter is released and a trigger signal $F_t$ is applied at the trigger terminal 23, the capacitor 18 discharges, causing the discharge tube 17 to flash.

Assuming the time periods $T_0$, $T_1$ and $T_2$ to be set at 20ms, 20ms and 4ms, respectively, and that the main capacitor 18 has a capacity that requires approximately four seconds to charge up if it is installed in a conventional charging circuit, the electronic flash charging circuit 10 including the booster circuit 11 according to the present invention can charge up the main capacitor 18 within approximately 2.4ms. This is comparable to the conventional one.

Figure 3:
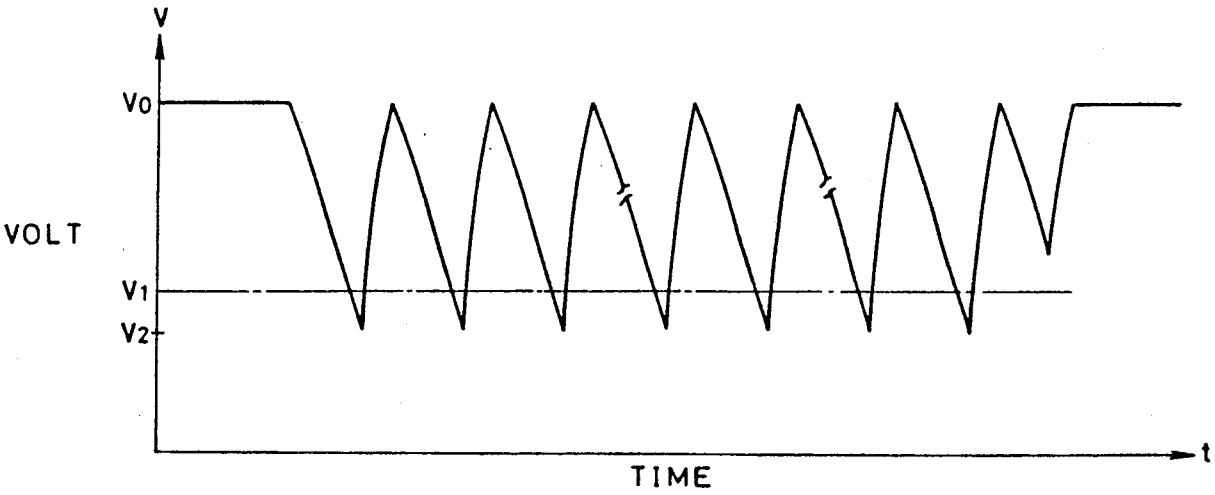
FIG. 3 is an explanatory graph showing the rise and fall of the supply voltage of the power source used in the charging circuit shown in FIG. 1.

During repeated change of the prohibiting signal between the high and low levels H and L, the voltage of the power source 1 changes between voltages $V_0$ and $V_2$ as is shown in FIG. 3. Voltages $V_0$ and $V_1$ in FIG. 3 represent a no-load voltage of the power source 1 and an operating voltage of the microcomputer 3, respectively.

If the trigger signal $F_c$ returns to the low level L from the high level H while the prohibiting signal $F_p$ is at the high level H, the charging circuit 10 allows the current to flow therethrough, including a fall of the supply voltage V of the power source 1. Upon the return of the prohibiting signal $F_p$ to the low level L from the high level H, the flow of current through the charging circuit 10 is shut off, reviving the power source 1. That is, the supply voltage V repeatedly rises and falls according to the change of the prohibiting signal $F_p$ between the low and high levels. Even if the supply voltage V falls below the working voltage $V_1$ of the microcomputer 3 during the prohibiting signal $F_p$ at the high level H, the back-up capacitor 4 discharges, supplying a sufficient voltage to the microcomputer 3. The back-up capacitor 4 is fully recharged while the prohibiting signal $F_p$ is at the low level L. Because the period during which the supply voltage V falls below the working voltage $V_1$ of the microcomputer 3 is only very short, the back-up capacitor 4 need only be small in capacity.

If the period for which the prohibiting signal $F_p$ is at the high level H is short, the power supply V can be revived before it has fallen below the working voltage $V_1$ of the microcomputer 3. This allows the back-up capacitor 4 to effect the prevention of noises to the microcomputer 3.

Because the booster circuit means of the charging circuit is intermittently activated to charge the main capacitor of the electronic flash, the power supply of the common source falls intermittently. The shorter the period for which the booster circuit means is activated, the less the fall of the supply voltage of the common power source below the working voltage of the microcomputer, so as to contribute to a stable power application to the microcomputer.

If the supply voltage of the common power source falls below the working voltage of the microcomputer, the period will in any event be quite short; and in any event the working voltage can be complemented by a back-up capacitor.

Although the present invention has been fully described by way of a particular embodiment thereof with reference to the accompanying drawings, it is to be noted that various changes and modifications will be apparent to those skilled in the art. Therefore, unless otherwise such changes and modifications depart from the scope of the present invention, they should be construed as included therein.

What is claimed is:

1. An electronic flash charging circuit for a camera having a power source common to a microcomputer that controls a plurality of camera functions and to an electronic flash, the charging circuit comprising:

booster circuit means for boosting a voltage applied to the charging circuit and charging a main capacitor of the electronic flash, said booster circuit means comprising a blocking oscillator; and control means for causing said booster circuit means to operate intermittently, thereby intermittently charging the main capacitor;

wherein said control means includes a transistor of which the emitter is connected to an input terminal of said blocking oscillator and the base is fed with a signal changing alternately between a high level and a low level.

2. A charging circuit as defined in claim 1, wherein the collector of said transistor is fed with a signal for disabling said transistor for a predetermined period of time after a discharge of said main capacitor.

3. A charging circuit as defined in claim 1, further comprising a back-up capacitor connected to said common power source parallel to said microcomputer for backing up said microcomputer.

4. An electronic flash charging circuit for a camera having a power source common to a microcomputer that controls a plurality of camera functions and to an electronic flash, the charging circuit comprising:

booster circuit means for boosting a voltage applied to the charging circuit and charging a main capacitor of the electronic flash from an initial voltage subsisting in the main capacitor after operation of the electronic flash, to a minimum operating voltage for the electronic flash; and control means for causing said booster circuit means to operate intermittently during charging of said main capacitor from the initial voltage to the minimum operating voltage, thereby intermittently recharging the main capacitor after actuation of said electronic flash.

5. A charging circuit as defined in claim 4, wherein said control means operates responsive to signals supplied from the microcomputer.

6. A charging circuit as defined in claim 4, wherein said booster circuit means comprises a blocking oscillator.

7. A charging circuit as defined in claim 6, wherein said control means includes a transistor of which the emitter is connected to an input terminal of said blocking oscillator and the base is fed with a signal changing alternately between a high level and a low level.

8. A charging circuit as defined in claim 7, wherein said signal changing alternately between a high level and a low level is generated by said microcomputer.

9. A charging circuit as defined in claim 7, wherein the collector of said transistor is fed with a signal for disabling said transistor for a predetermined period of time after a discharge of said main capacitor.

10. A charging circuit as defined in claim 4, further comprising a back-up capacitor connected to said common power source parallel to said microcomputer, for backing up said microcomputer.

11. A charging circuit as defined in claim 10, wherein said back-up capacitor has a capacity which is so defined as to supply the microcomputer with a minimum operating voltage therefor, when the voltage of the power source falls below said minimum operating voltage of the microcomputer.

* * * * *